US007975572B2

(12) United States Patent
Nelson

(10) Patent No.: US 7,975,572 B2
(45) Date of Patent: Jul. 12, 2011

(54) METHODS AND APPARATUS FOR MAKE UP AND BREAK OUT OF TUBULAR CONNECTIONS

(75) Inventor: Robert M. Nelson, Ventura, CA (US)

(73) Assignee: Weatherford/Lamb, Inc., Houston, TX (US)

( * ) Notice: Subject to any disclaimer, the term of this patent is extended or adjusted under 35 U.S.C. 154(b) by 210 days.

(21) Appl. No.: 12/244,341

(22) Filed: Oct. 2, 2008

(65) Prior Publication Data

US 2010/0083796 A1 Apr. 8, 2010

(51) Int. Cl.
*B25B 13/50* (2006.01)

(52) U.S. Cl. ..... 81/57.18; 81/57.2

(58) Field of Classification Search ..... 81/57.18, 81/57.15, 57.2, 57.33
See application file for complete search history.

(56) References Cited

U.S. PATENT DOCUMENTS

| | | | | |
|---|---|---|---|---|
| 3,261,241 | A * | 7/1966 | Catland | 81/57.18 |
| 3,371,562 | A | 3/1968 | Kelley | |
| 4,084,453 | A | 4/1978 | Eckel | |
| 4,246,809 | A | 1/1981 | Keast et al. | |
| 4,290,304 | A | 9/1981 | Eckel | |
| 4,437,363 | A | 3/1984 | Haynes | |
| 5,291,808 | A | 3/1994 | Buck | |
| 5,819,604 | A * | 10/1998 | Buck | 81/57.18 |

* cited by examiner

*Primary Examiner* — D. S Meislin
(74) *Attorney, Agent, or Firm* — Patterson & Sheridan, LLP

(57) ABSTRACT

A gripping apparatus and a method apparatus for making up and breaking out tubular connections. In one embodiment, the gripping apparatus comprises an outer gear, a plurality of rollers coupled to the outer gear, an inner ring, a passive jaw, and a pair of active jaws pivotably coupled to the inner ring. The active jaws include camming surfaces for positioning, securing, actuating, and retracting the active jaws upon rotation of the outer gear. The gripping apparatus may further include a control switch operable to maintain the gripping apparatus in a make up mode or a break out mode regardless of rotation of the outer gear.

23 Claims, 15 Drawing Sheets

METHODS AND APPARATUS FOR MAKE UP AND BREAK OUT OF TUBULAR CONNECTIONS

BACKGROUND OF THE INVENTION

1. Field of the Invention

Embodiments of the invention relate to methods and apparatus for making up and breaking out tubular connections. In particular, embodiments of the invention relate to a gripping apparatus operable to make up or break out a tubular connection.

2. Description of the Related Art

Oilfield tubulars such as drill pipe, tubing, casing, and the like are employed in sections which are joined together at their ends by threaded connections. Typically, power tong assemblies are used to make up or break out a threaded connection. A typical power tong includes a device for gripping the external surface of a tubular section and then rotating the tubular section while the tubular to which it is connected is held stationary or rotated in the opposite direction.

Existing power tong assemblies generally have one fixed gripping jaw and one active gripping jaw that are assembled in a carrier ring or inner ring. The active jaw cams onto the tubular and forces the tubular into the fixed jaw to grip and rotate the tubular. However, to change from make up to break out, or visa versa, the jaw gripping rotation must be reversed. Generally, the active jaw and fixed jaw must be manually removed and reinstalled 180 degrees in the inner ring to the rotation needed. By doing this manual jaw change the tubular must be removed from the power tong assembly and the jaws adjusted to the make or break position. This manual adjustment is time consuming and is a major safety hazard.

There are other power tong assemblies with jaw gripping designs that do not require manual adjustment of the jaws for transitioning between make up and break out. Although assemblies of this type have proven satisfactory, extensive use and experimentation has shown that improvements are needed, particularly with respect to the jaw gripping design and the means for urging the jaws into contact with the pipe.

There is a need, therefore, for a new and improved method and apparatus for making up and breaking out tubular connections. There is also a need for a new and improved jaw gripping design for engaging and disengaging a tubular during a make up or break out connection.

SUMMARY OF THE INVENTION

Embodiments of the invention relate to a gripping apparatus for making up and breaking out tubular connections. The apparatus may comprise an outer gear, an inner ring rotatably coupled to the outer gear, and a first active jaw pivotably coupled to the inner ring. The first active jaw may include a securing cam surface and an actuating cam surface. Engagement with the securing cam surface secures the first active jaw in contact with the tubular to provide a reactive force. Engagement with the actuating cam surface actuates the first active jaw into engagement with the tubular and applies a gripping force onto the tubular.

In one embodiment, a gripping apparatus for engaging a tubular may comprise an outer gear, an inner ring rotatably coupled to the outer gear, a first active jaw, and a second active jaw. Each of the active jaws may be pivotably coupled to the inner ring. Rotation of the outer gear actuates the second active jaw into engagement with the tubular to apply a gripping force onto the tubular. Rotation of the outer gear also secures the first active jaw in contact with the tubular to provide a reactive force against the gripping force.

In one embodiment, a method of making up or breaking out a tubular connection may comprise the step of providing a gripping apparatus. The gripping apparatus may comprise an outer gear, a plurality of rollers coupled to the outer gear, an inner ring rotatably coupled to the outer gear, and a plurality of active jaws. The method may also comprise the step of securing a first active jaw in contact with a tubular by rotating the outer gear so that a first roller engages a securing cam surface of the first active jaw. The method may further comprise the step of actuating a second active jaw into engagement with the tubular by rotating the outer gear so that a second roller engages an actuating cam surface of the second active jaw. The method may further comprise the steps of applying a gripping force to the tubular using the second active jaw, applying a reactive force to the tubular using the first active jaw, and applying torque to the outer gear to rotate the tubular.

In one embodiment, a method of making up or breaking out a tubular connection may comprise the step of providing a gripping apparatus. The gripping apparatus may have a plurality of rollers and a plurality of active jaws. The method may also comprise the step of rotating the plurality of rollers relative to the plurality of active jaws and securing a first active jaw in contact with a tubular using a first roller. The first active jaw includes a securing cam surface and an actuating cam surface. The method may further comprise the step of actuating a second active jaw into engagement with the tubular using a second roller. The second active jaw also includes a securing cam surface and an actuating cam surface. The method may further comprise the step of gripping the tubular using the plurality of active jaws and rotating the tubular.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
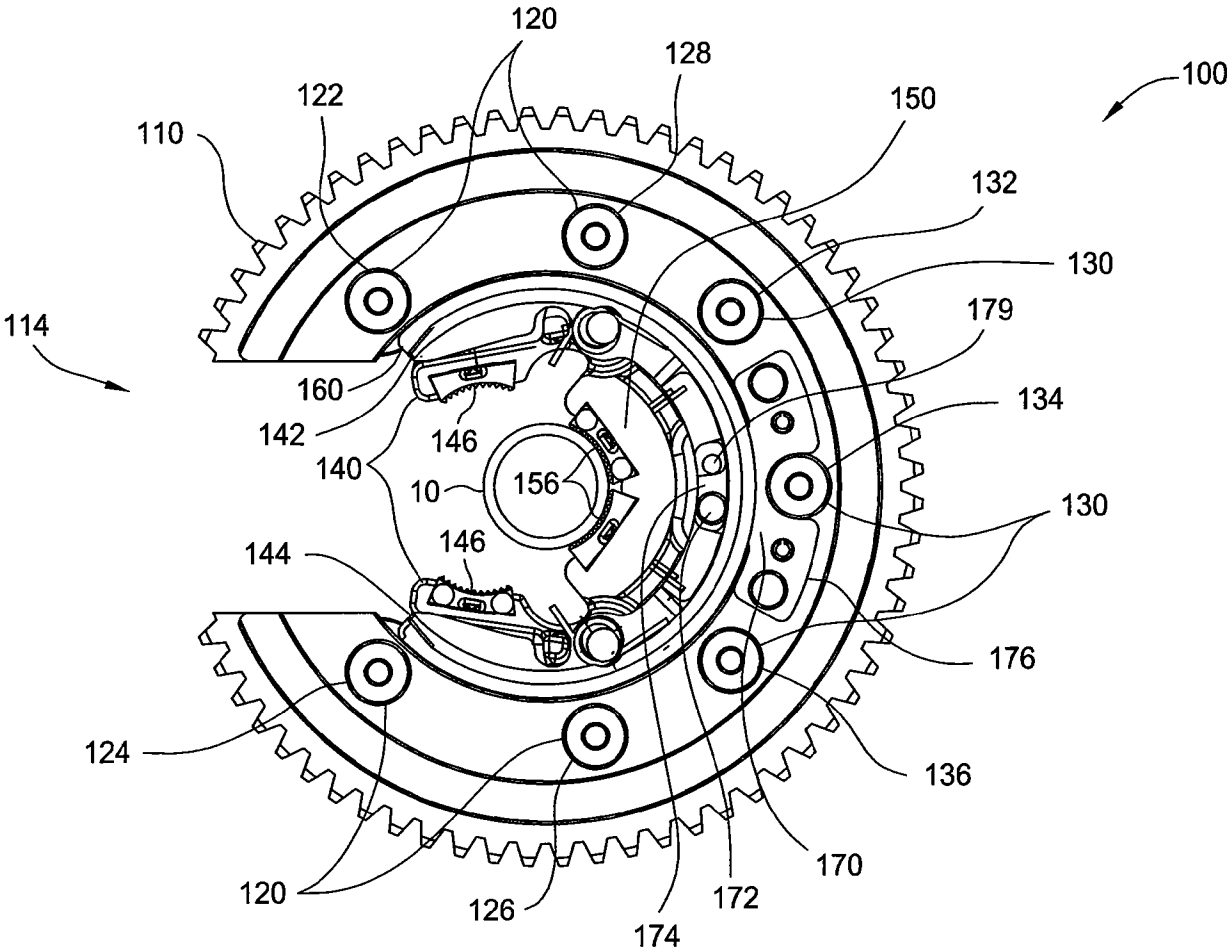
FIGS. 1A and 1B illustrate a top view of the gripping apparatus in an open position.
Figure 1B:
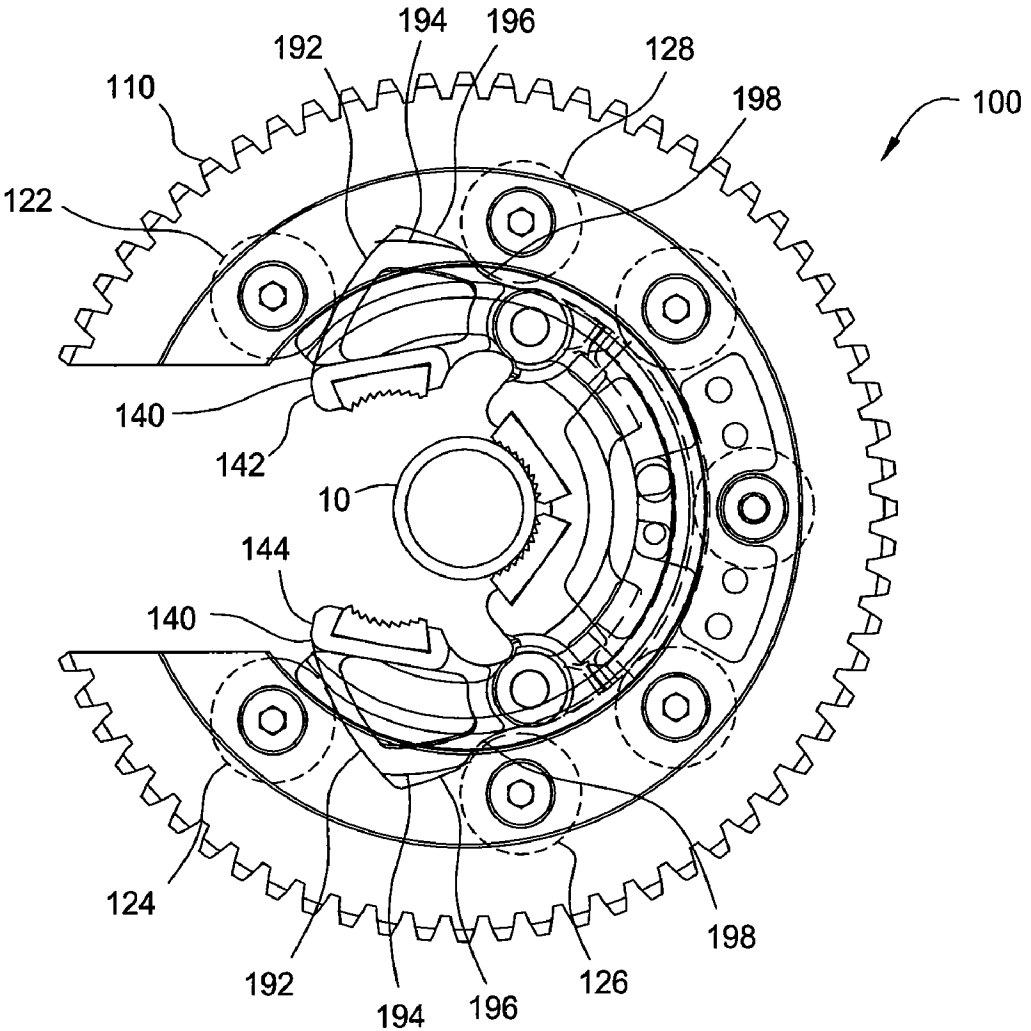

Embodiments of the invention include a gripping apparatus that may be coupled to a rotary for applying torque thereto. FIGS. 1A and 1B illustrate the gripping apparatus 100 in an open position for the introduction of a tubular 10 therein. Examples of suitable tubulars 10 include drill pipe, casing, liner, tubing, and other types of downhole tubulars as is known in the art. The gripping apparatus 100 includes an outer gear 110, a first group of rollers 120, a second group of rollers 130, a pair of active jaws 140, a passive jaw 150, an inner ring 160, and a control switch 170. The gripping apparatus 100 may be actuated into the open position to allow a tubular 10 to be introduced into the gripping apparatus 100 to make up a connection with another tubular or tubular string, or to break out from a connection with another tubular or tubular string. In one embodiment, at least one of the active jaws 140 may be interchanged with another active jaw to accommodate a variety of tubular diameter sizes. In another embodiment, the pair of active jaws 140 may be adapted to accommodate a variety of tubular diameter sizes.

The gripping apparatus 100 includes gripping members such as, a first active jaw 142, a second active jaw 144, and the passive jaw 150 supported in the inner ring 160, which are all disposed in the interior of the outer gear 110. The passive jaw 150 is secured to the inner ring 160, and the active jaws 140 are pivotably coupled to the inner ring 160. In one embodiment, the gripping apparatus may include one or more passive jaws 150. Each of the active jaws 140 are adapted to apply a gripping force and provide a reactive force, and the passive jaw 150 is adapted to provide a reactive force. The rollers are disposed in the outer gear 110, and are operable to support the inner ring 160 and the active and passive jaws 140 and 150. In particular, the first group of rollers 120 are operable to actuate the active jaws 140, and the second group of rollers 130 are operable to support the passive jaw 150. The gripping apparatus 100 is adapted to make up and break out tubular connections by clockwise and counterclockwise rotation of the outer gear 110.

In one embodiment, the gripping apparatus 100 may further comprise a friction surface 185, such as a "brake band," disposed between the outer gear 110 and the inner ring 160. The friction surface 185 allows relative rotation between the ring surfaces so that the rollers may fully engage and disengage from the jaws. The friction surface 185 helps prevent premature uniform rotation between the outer gear 110 and the inner ring 160.

The contact surface of the active and passive jaws 140 and 150 may include removable gripping elements 146 and 156, respectively. In one embodiment, the passive jaw 150 may include two gripping elements 156. The gripping elements 146 and 156 may comprise teeth or inserts for frictional contact with the tubular 10. In one embodiment, the gripping element 146 of at least one active jaw and at least one of the gripping elements 156 of the passive jaw 150 include teeth that are operable to engage the tubular upon clockwise rotation of the tubular relative to the gripping elements 146 and 156. In one embodiment, the gripping element 146 of at least one active jaw and at least one of the gripping elements 156 of the passive jaw 150 include teeth that are operable to engage the tubular upon counterclockwise rotation of the tubular relative to the gripping elements 146 and 156. In an alternative embodiment, all of the gripping elements 146 and 156 comprise teeth operable to engage the tubular upon clockwise and counterclockwise rotation of the tubular relative to the gripping elements 146 and 156.

As illustrated, the active jaws 140 are in a retracted position. Generally, the first group of rollers 120 cam along the back surfaces of the active jaws 140 by rotation of the outer gear 110 to pivot the active jaws 140 away from the interior of the gripping apparatus 100. The tubular 10 is introduced through an opening 114 in the outer gear 110 into the center of the gripping apparatus 100 until it engages the passive jaw 150. Depending on whether a make up or break out operation is needed, the control switch 170 may be selectively adjusted so that the gripping apparatus 100 will operate in only a make up mode or a break out mode, regardless of the direction of rotation of the outer gear 110.

The control switch 170 includes a switch 172, such as a key or pin, a switch housing 174, and a switch plate 176 that couples the switch housing 174 to the outer gear 110. The switch 172 is disposed through the switch housing 174 and engages the inner ring 160 (further described below) to provide limited relative rotation between the outer gear 110 and the inner ring 160. The control switch 170 is operable to maintain the gripping apparatus in the make up or break out modes. The make up and break out modes are selected by placing the switch 172 in a first opening 177 (for make up mode) or a second opening 179 (for break out mode) in the switch housing 174. In one embodiment, the switch 172 may be manually placed in the openings 177 and 179 of the switch housing 174 to operate the gripping apparatus 100 in the make up or break out mode. In an alternative embodiment, the switch 172 may be placed in the openings 177 and 179 of the switch housing 174 using an automated device.

In one embodiment, when positioned in the make up mode, the control switch 170 limits relative rotation between the outer gear 110 and the inner ring 160 to prevent the actuation of the gripping apparatus 100 when it is rotated in the break out direction. In particular, upon rotation of the outer gear 110 in the break out direction, the control switch 170 engages the inner ring 160 (further described below) so that the outer gear 110 and inner ring 160 will rotate together. The engagement of the inner ring 160 by the control switch 170 prevents the first group of rollers 120 on the outer gear 110 from actuating the active jaws 140 when rotated in the break out direction. When rotated in the make up direction, the control switch 170 allows relative rotation between the outer gear 110 and the inner ring 160 to permit the actuation of the gripping apparatus 100. In particular, the control switch 170 permits the first group of rollers 120 on the outer gear 110 to actuate the active jaws 140 when rotated in the make up direction. The reverse of this functional feature of the control switch 170 and the gripping apparatus 100 occurs when the control switch 170 is positioned in the break out mode. Therefore, the gripping apparatus 100 may be continuously operated in either the make up mode or break out mode, regardless of the direction of rotation of the gripping apparatus 100, using the control switch 170.

In one embodiment, the control switch 170 is adjusted to operate the gripping apparatus 100 in the make up mode. Rotation of the outer gear 110 in a clockwise direction will allow the active jaws 140 to engage and rotate the tubular 10 to make up a connection. Upon engagement with the tubular 10, the active jaws 140 and the passive jaw 150, including the inner ring 160, will rotate in unison with the outer gear 110. Rotation of the outer gear 110 in a counterclockwise direction will allow the active jaws 140 to disengage from the tubular 10 and move back into the retracted position to release the tubular 10. Upon disengagement, the outer gear 110 may continuously be rotated in the counterclockwise direction without re-engaging the tubular 10. In particular, the control switch 170 allows the active jaws 140 (in the retracted position) and the passive jaw 150, including the inner ring 160, to rotate in unison with the outer gear 110 in the counterclockwise direction. Another tubular may then be introduced into the gripping apparatus 100 for another make up operation.

In one embodiment, the control switch 170 is adjusted to operate the gripping apparatus 100 in the break out mode.

Rotation of the outer gear 110 in a counterclockwise direction will allow the active jaws 140 to engage and rotate the tubular 10 to break it out from a connection. Upon engagement with the tubular 10, the active jaws 140 and the passive jaw 150, including the inner ring 160, will rotate in unison with the outer gear 110. Rotation of the outer gear 110 in a clockwise direction will allow the active jaws 140 to disengage from the tubular 10 and move back into the retracted position to release the tubular 10. Upon disengagement, the outer gear 110 may continuously be rotated in the clockwise direction without re-engaging the tubular 10. In particular, the control switch 170 allows the active jaws 140 (in the retracted position) and the passive jaw 150, including the inner ring 160, to rotate in unison with the outer gear 110 in the clockwise direction. Another tubular may then be introduced into the gripping apparatus for another break out operation.

Referring to FIG. 1B, the first group of rollers 120 includes a first pair of camming members, such as slotted rollers 122 and 124, and a second pair of camming members, such as non-slotted rollers 126 and 128 for engaging the active jaws 140. FIG. 1B shows the engagement of the first group of rollers 120 with the camming surfaces of the active jaws 140 to retract the active jaws 140 in the open position. Each of the active jaws 140 includes a positioning cam surface 192, a securing cam surface 194, an actuating cam surface 196, and a retracting cam surface 198 (further described below in FIG. 5B). The rollers 122 and 124 engage the ends of the positioning cam surface 192, and the rollers 126 and 128 engage the retracting cam surface 198 to facilitate retraction of the active jaws 140 to allow the tubular 10 to be introduced into the gripping apparatus 100.

Figure 2:
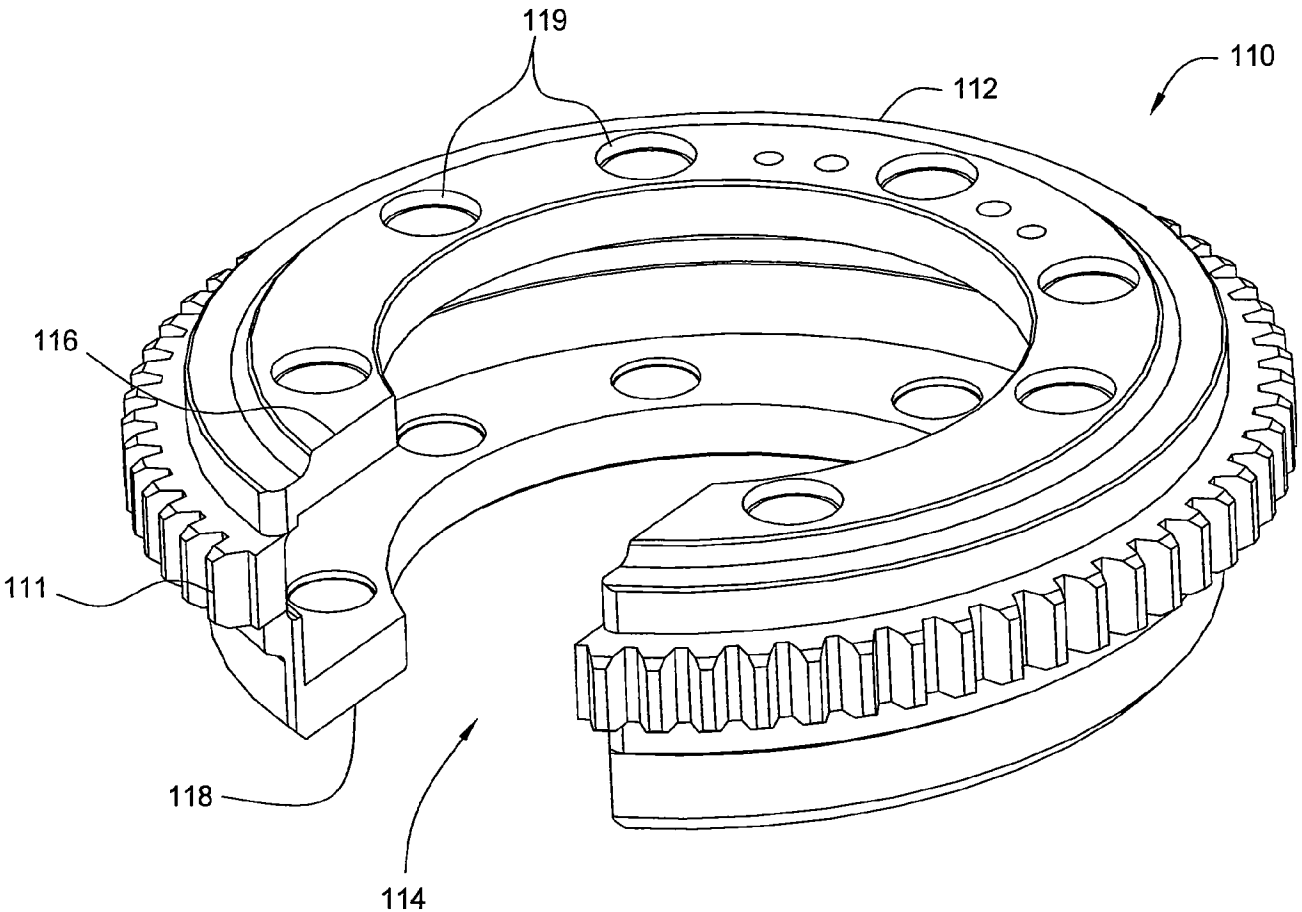
FIG. 2 illustrates an isometric view of an outer gear.

FIG. 2 illustrates the outer gear 110 according to one embodiment. The outer gear includes a ring-shaped body 112 having an opening 114 through which tubulars are introduced into the gripping apparatus 100. The body 112 further includes a recessed interior with an upper section 116 and a lower section 118. The upper and lower sections 116 and 118 each having a plurality of concentrically placed openings 119 disposed through the sections for housing the first and second group of rollers 120 and 130. The outer gear 110 also includes a plurality of teeth 111 disposed on the outer periphery of the body 112 for engagement with a rotary (not shown) and located between the upper and lower sections 116 and 118.

Figure 3:
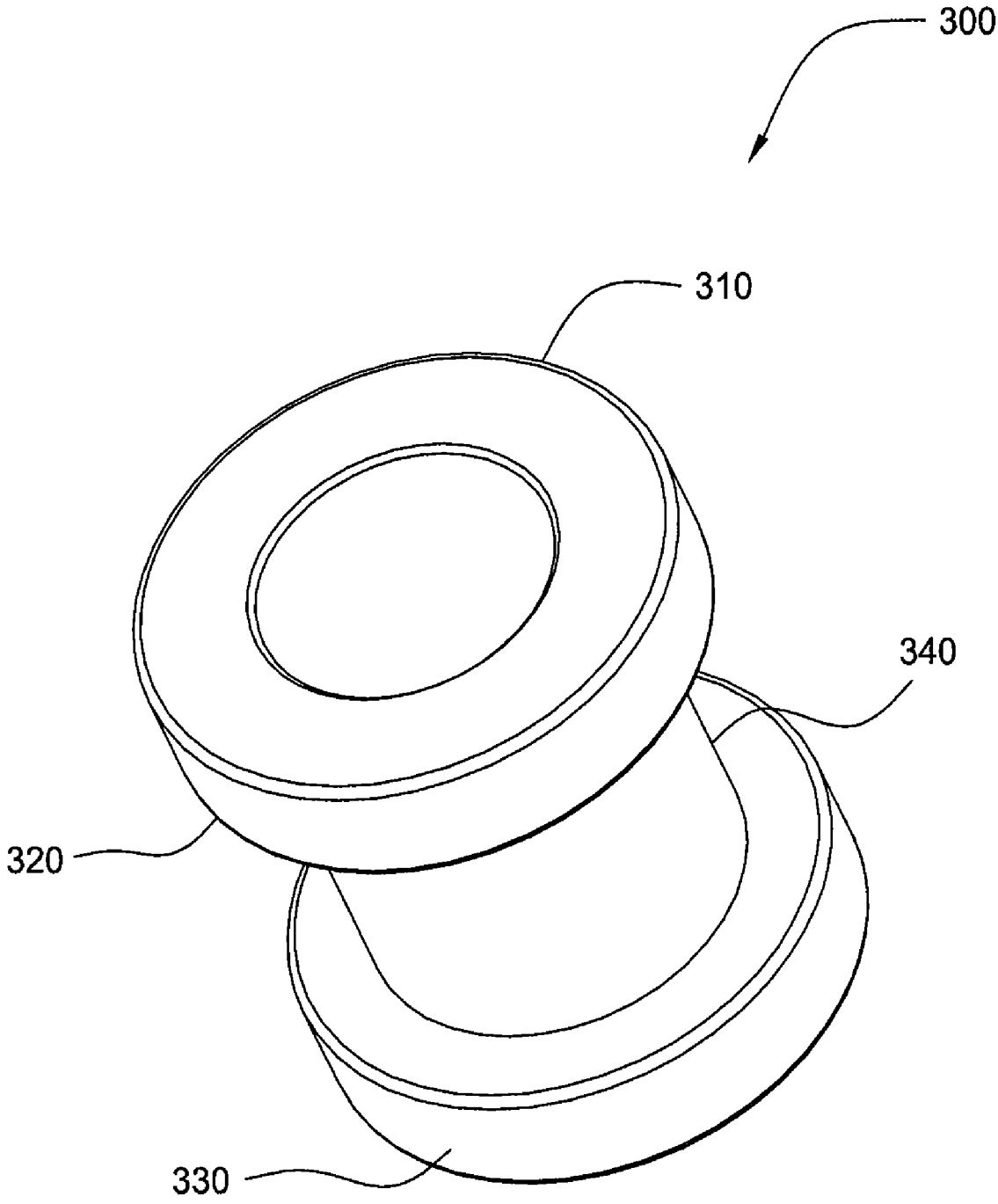
FIGS. 3 and 4 illustrate an isometric view of a slotted roller and a non-slotted roller.
Figure 4:
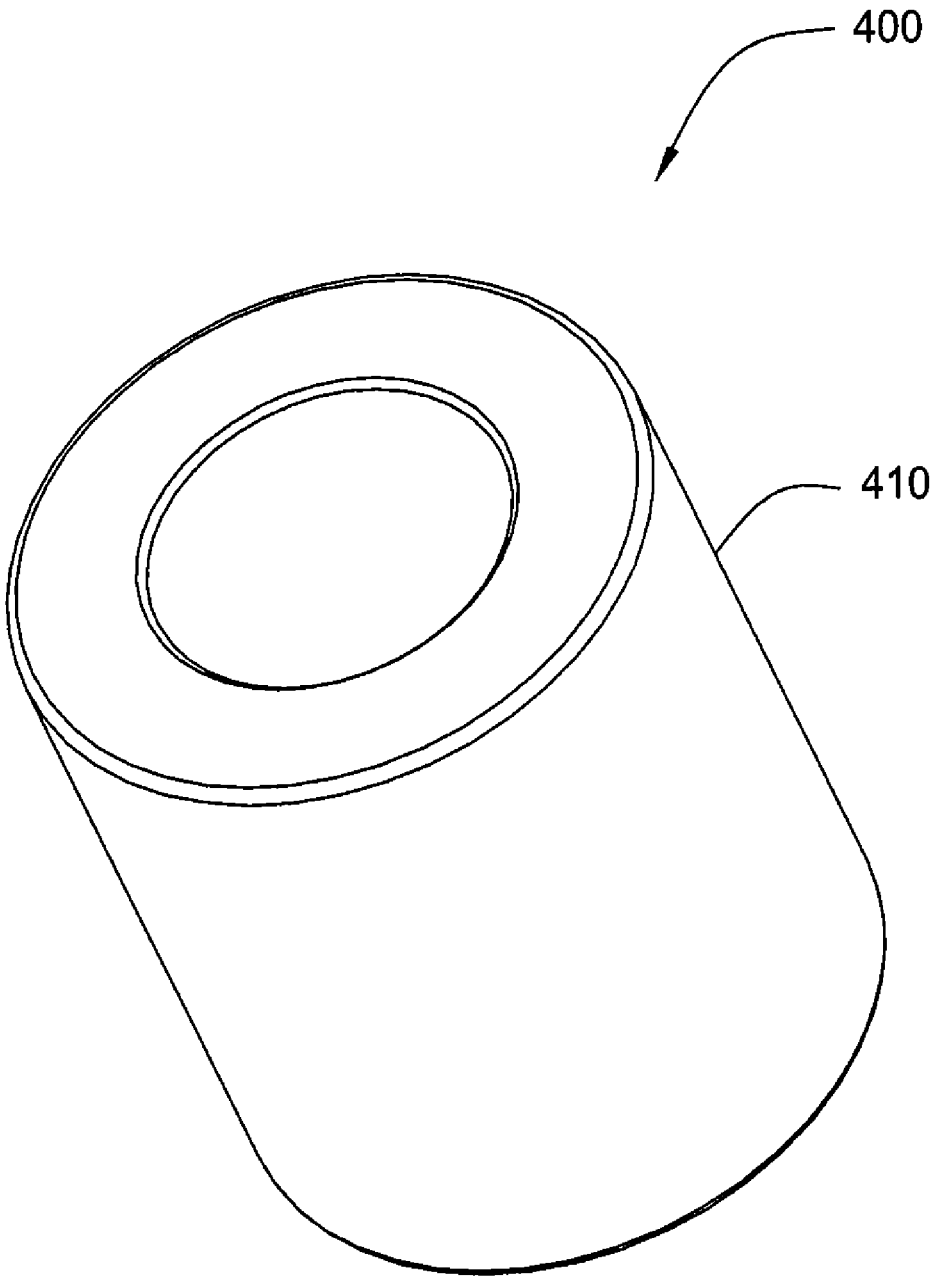

FIGS. 3 and 4 show the different types of camming members that are located in the gripping apparatus 100. FIG. 3 illustrates a camming member, such as a slotted roller 300 according to one embodiment. The slotted roller 300 includes a cylindrical body 310 having an upper end 320 and a lower end 330 having similar outer diameters, and a middle section 340 disposed between the ends having an outer diameter smaller than the upper and lower ends 320 and 330. The slotted roller 300 may form a "dumbbell" shaped profile. The upper and lower ends 320 and 330 of the slotted roller 300 are adapted to engage the positioning cam surface 192 and the securing cam surface 194 on the active jaws 140 to position and to secure the active jaws 140 into contact with a tubular located in the gripping apparatus 100, respectively. FIG. 4 illustrates a camming member, such as a non-slotted roller 400 according to one embodiment. The non-slotted roller 400 includes a cylindrical body 410 having a uniform outer diameter from top to bottom. The non-slotted roller 400 is adapted to engage the retracting cam surface 198 on the active jaws 140 to retract the active jaws 140, and is adapted to engage the actuating cam surface 196 on the active jaws 140 to apply a radial force on the active jaws 140 to pivot the active jaws 140 into further engagement with the tubular located in the gripping apparatus 100. In addition, the second group of rollers 130 comprise three camming members, such as non-slotted rollers 132, 134, and 136 for supporting the passive jaw 150.

Figure 5A:
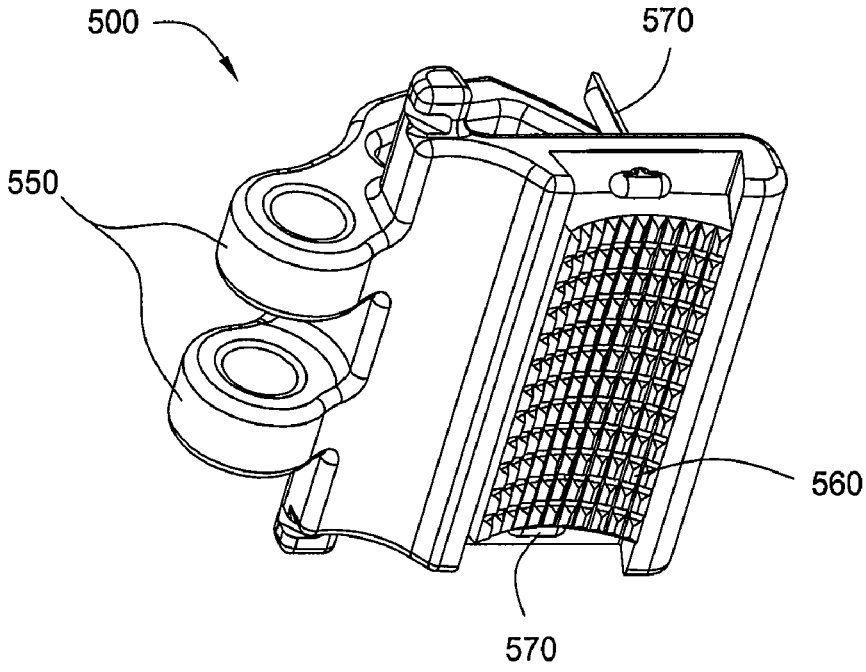
FIGS. 5A and 5B illustrates an isometric front and back view of an active jaw.
Figure 5B:
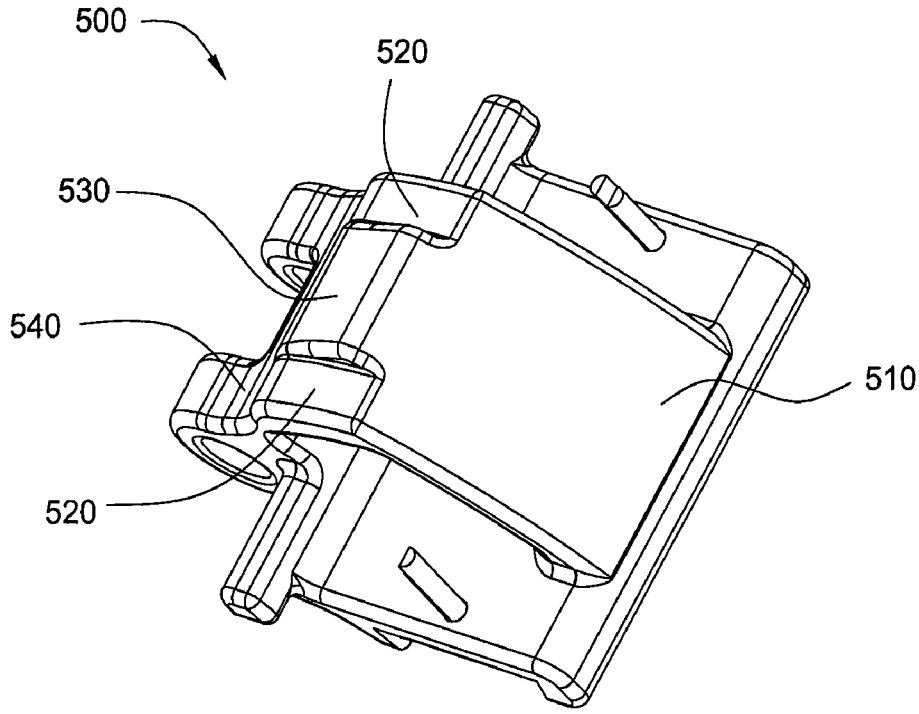

FIGS. 5A and 5B illustrate a front and back view of a gripping member, such as an active jaw 500, respectively, according to one embodiment. FIG. 5A of the active jaw 500 shows a pair of hinges 550 located along the side of the active jaw 500 for pivotably coupling the active jaw to the inner ring. The active jaw 500 also includes a removable gripping element 560 having teeth for engaging tubulars, and a pair of pins 570 for securing the gripping element 560 to the body of the active jaw 500. As stated above, the gripping element 560 may be adapted to engage a tubular upon clockwise rotation, counterclockwise rotation, or both, of a tubular relative to the active jaw 500.

FIG. 5B shows a back view of the active jaw 500, specifically, the camming surfaces on the backside of the active jaw 500 are illustrated. Each active jaw 500 has a positioning cam surface 510, a pair of securing cam surfaces 520, a actuating cam surface 530 disposed between the securing cam surfaces 520, and a retracting cam surface 540. The positioning cam surface 510 positions the active jaw 500, such that upon contact with the rollers the active jaw 500 is positioned into initial contact with the tubular located in the gripping apparatus. The pair of securing cam surfaces 520 secures the active jaw 500, such that upon contact with the rollers the active jaw 500 is held into contact with the tubular located in the gripping apparatus 100 to provide a reactive force. The actuating cam surface 530 actuate the active jaw 500, such that upon contact with the rollers the active jaw 500 is pivoted into engagement with the tubular located in the gripping apparatus 100 to apply a gripping force on the tubular. The retracting cam surface 540 retract the active jaw 500, such that upon contact with the rollers the active jaw 500 is pivoted away from engagement with the tubular located in the gripping apparatus 100 and into the retraced position as illustrated in FIG. 1B. Referring to FIG. 1B, each of the active jaws 140 are placed in the retracted position by the non-slotted rollers 126 and 128 engaging the retracting cam surface 198 of the active jaws 140, thereby pivoting the active jaws 140 away from the center of the gripping apparatus 100.

In one embodiment, the securing and actuating cam surfaces 520 and 530 are disposed between the positioning cam surface 510 and the retracting cam surface 540. In one embodiment, the actuating cam surface 530 includes a raised portion disposed between the securing cam surfaces 520. In one embodiment, the active jaw 500 includes a single securing cam surface that may be disposed above or below the actuating cam surface. In one embodiment, the securing cam surfaces 520 include a radiused outer surface that is concentric with the center of the gripping apparatus 100 and the tubular so that the active jaw 500 is held in contact with the tubular, does not exert a gripping force on the tubular, but does provide a reactive force.

Figure 6:
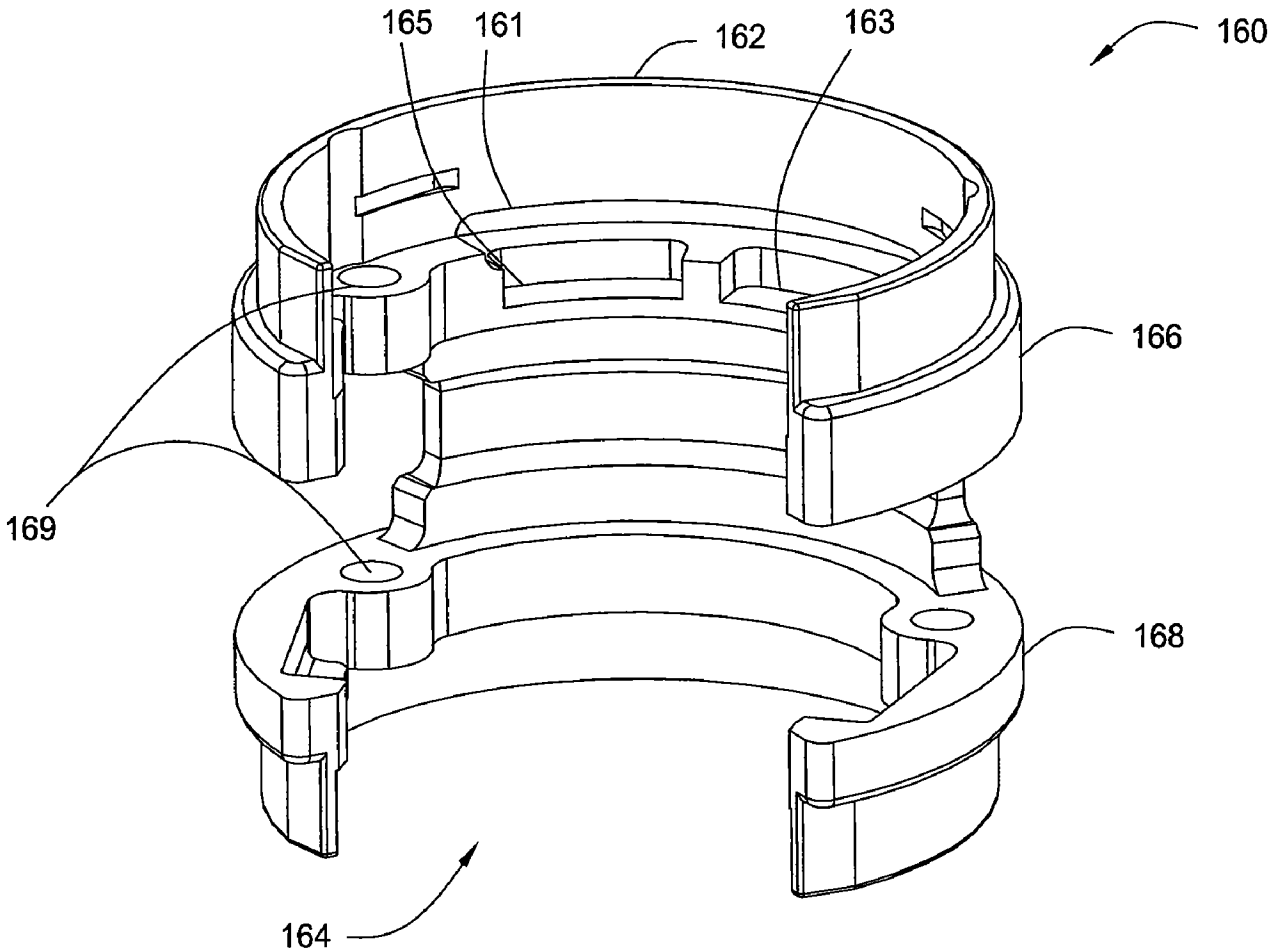
FIG. 6 illustrates an isometric view of an inner ring.

FIG. 6 illustrates a carrier member, such as the inner ring 160 according to one embodiment. The inner ring is rotatably coupled to the outer gear 110. The inner ring 160 includes a ring-shaped body 162 having an opening 164 through which tubulars are introduced into the gripping apparatus 100. The opening 164 corresponds with the opening 114 of the outer gear 110 when the gripping apparatus is in the open position. The body 162 further includes a recessed interior with an upper section 166 and a lower section 168. The second group of rollers 130 are adapted to support the body 162 by engaging shoulders disposed on the outer periphery of the body 162 between the upper and lower sections 166 and 168. The upper and lower sections 166 and 168 each have aligned openings 169 disposed through the sections for coupling the active and passive jaws 140 and 150 to the inner ring. The upper section 166 further includes a window 161 disposed through the body 162 of the inner ring 160, and a make up slot 163 and a break out slot 165 disposed adjacent the window 161. The window 161 is provided to allow the switch plate 176 (shown in FIG. 1) of the control switch 170 to extend from the outer gear 110 through the body 162 of the inner ring 160. The switch housing 174 is disposed on the end of the switch plated 176 such that it is located within the inner ring 160. The switch 172 is disposed through the switch housing 174 and is located in either the make up slot 163 or the break out slot 165 to select the mode of operation of the gripping apparatus 100.

In one embodiment, the switch 172 is located in the make up slot 163 of the inner ring 160. Upon rotation of the outer gear 110 in the clockwise direction, the switch 172 and the switch housing 174 will slide to a first end of the make up slot 163, and the rollers will actuate the active jaws 140 into engagement with the tubular. Further rotation of the outer gear 110 will rotate the inner ring 160 and the outer gear 110 together by engagement of the active jaws 140 to the tubular, thereby rotating the tubular. Upon rotation of the outer gear 110 in the counterclockwise direction, the switch 172 and the switch housing 174 will slide to the opposite end of the make up slot 163, and the rollers will retract the active jaws 140 from engagement with the tubular. Further rotation of the outer gear 110 will rotate the inner ring 160 and the outer gear 110 together, thereby preventing the active jaws 140 from re-engaging the tubular or positioning the gripping apparatus in the break out mode. In particular, the switch 172 prevents further rotation of the outer gear 110 relative to the inner ring 160, as it is travels within the make up slot 163. A similar operation of the gripping apparatus 100 is followed when the switch 172 is located in the break out slot 165 of the inner ring 160, however, counterclockwise rotation of the outer gear 110 actuates the active jaws 140 into engagement with the tubular, and clockwise rotation of the outer gear 110 retracts the active jaws 140 from engagement with the tubular.

Figure 7A:
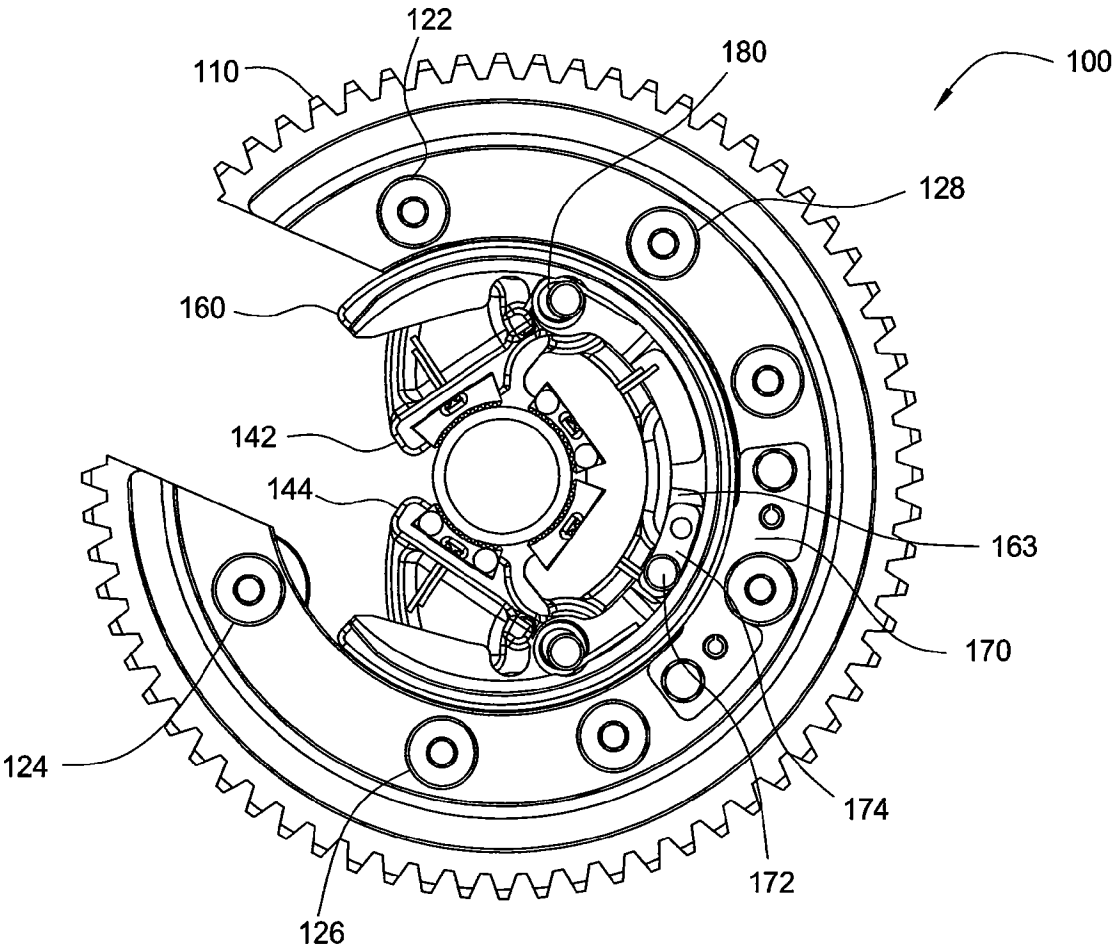
FIGS. 7A and 7B illustrate a top view of the gripping apparatus in a make up mode.
Figure 7B:
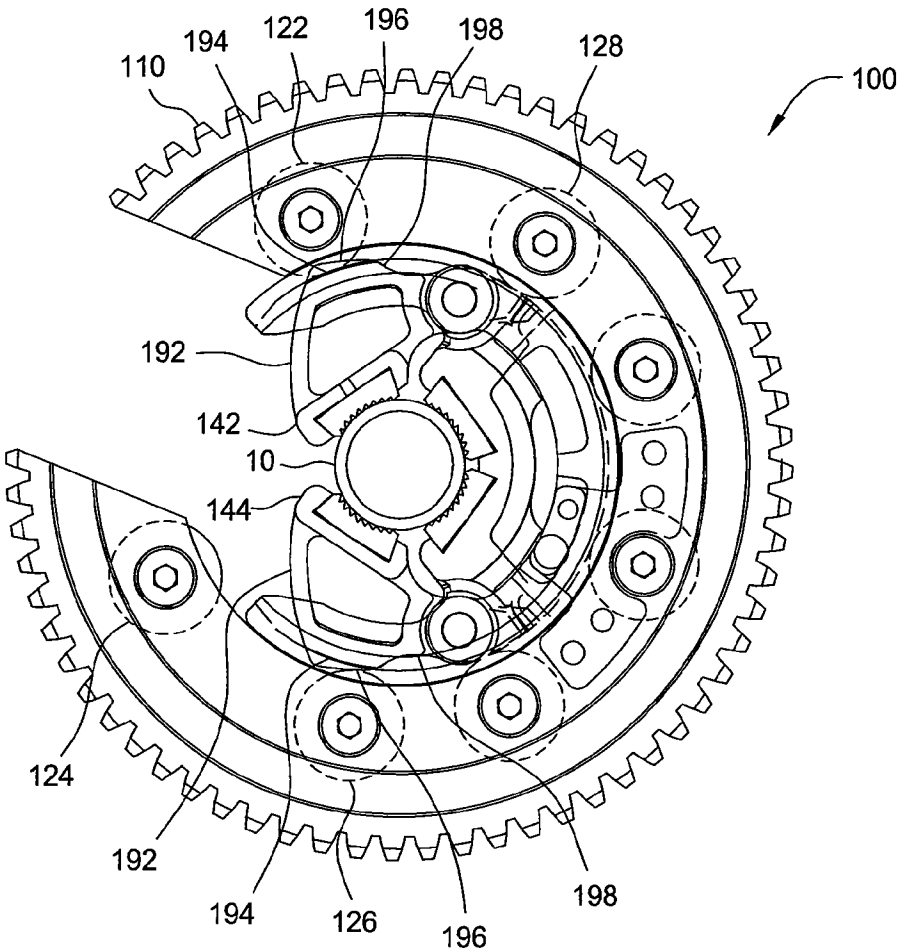

FIGS. 7A and 7B illustrate the gripping apparatus 100 in a make up mode. The active jaws 140 are illustrated in the engaged position. As illustrated, the switch 172 is located in the switch housing 174 so that it extends into the make up slot 163 of the inner ring 160. The outer gear 110 is shown rotated in the clockwise direction. The upper and lower sections of the slotted roller 122 of the first group of rollers 120 initially cams along the positioning cam surface 192 of the first active jaw 142 to pivot the first active jaw 142 into position for initial contact with the tubular 10 disposed in the gripping apparatus 100. The upper and lower sections of the slotted roller 122 then cam along the securing cam surfaces 194 of the first active jaw 142 to secure the first active jaw 142 in contact with the tubular 10. The slotted roller 122 does not engage the actuating cam surface 196 of the first active jaw 142, as the actuating cam surface 196 passes between the upper and lower sections of the slotted roller 122. At about the same time, the non-slotted roller 126 of the first group of rollers 120 cams from the retracting cam surface 198 of the second active jaw 144 to the actuating cam surface 196 of the second active jaw 144. The non-slotted roller 126 cams along the actuating cam surface 196 to pivot the second active jaw 144 into engagement with the tubular 10 so that a gripping force is applied to the tubular 10. A reactive force is provided by the passive jaw 150 and the first active jaw 142. Further rotation of the outer gear 110 in the clockwise direction will rotate the inner ring 160, and thus the active and passive jaws 140 and 150, thereby rotating the tubular 10 to conduct a make up operation.

After the make up operation is complete, the outer gear 110 is rotated in the counterclockwise direction to retract the active jaws 140 from engagement with the tubular 10. The slotted roller 122 cams from the securing cam surfaces 194 to the positioning cam surface 192 of the first active jaw 142 to pivot the first active jaw 142 away from the center of the gripping apparatus 100. The non-slotted roller 128 engages the retracting cam surface 198 to fully retract the first active jaw 142. At about the same time, non-slotted roller 126 cams from the actuating cam surface 196 to the retracting cam 198 surface of the second active jaw 144 to pivot the second active jaw 144 away from the center of the gripping apparatus 100 and fully retract the second active jaw 144.

In addition, the gripping apparatus 100 includes biasing members 180 to facilitate retraction of the active jaws 140. In one embodiment, the biasing members 180 include springs that are adapted to provide a reactive force on the active jaws 140 to help retract the active jaws 140 from engagement with the tubular and into an open position.

Further rotation of the outer gear 110 in the counterclockwise direction will rotate the inner ring 160, and thus the active and passive jaws 140 and 150 together. The switch 172 will travel within the make up slot 163 to allow the active jaws 140 to be fully retracted. The switch 172 may then engage the end of the make up slot 163 to prevent further relative rotation between the outer gear 110 and the inner ring 160. The control switch 170 maintains the gripping apparatus 100 in the make up mode.

F*igure* 8A illustrates a cross sectional view of the first active jaw 142 engaged with the slotted roller 122 at interface 190. In particular, the upper and lower sections of the slotted roller 122 engage the securing cam surfaces 194 of the first active jaw 142. The actuating cam surface 196 is disposed between the upper and lower sections of the slotted roller 122. The outer diameter of the middle section of the slotted roller 122 is reduced so that the slotted roller 122 does not engage the actuating cam surface 196 of the first active jaw 142. In the illustrated position, the slotted roller 122 secures the first active jaw 142 into contact with the tubular 10 disposed in the gripping apparatus 100. In an alternative embodiment, the slotted roller 122 and the securing cam surfaces 194 of the first active jaw 142 are dimensioned to allow the slotted roller 122 to pivot the first active jaw 142 into engagement with the tubular, so that a gripping force is applied to the tubular 10.

Figure 8A:
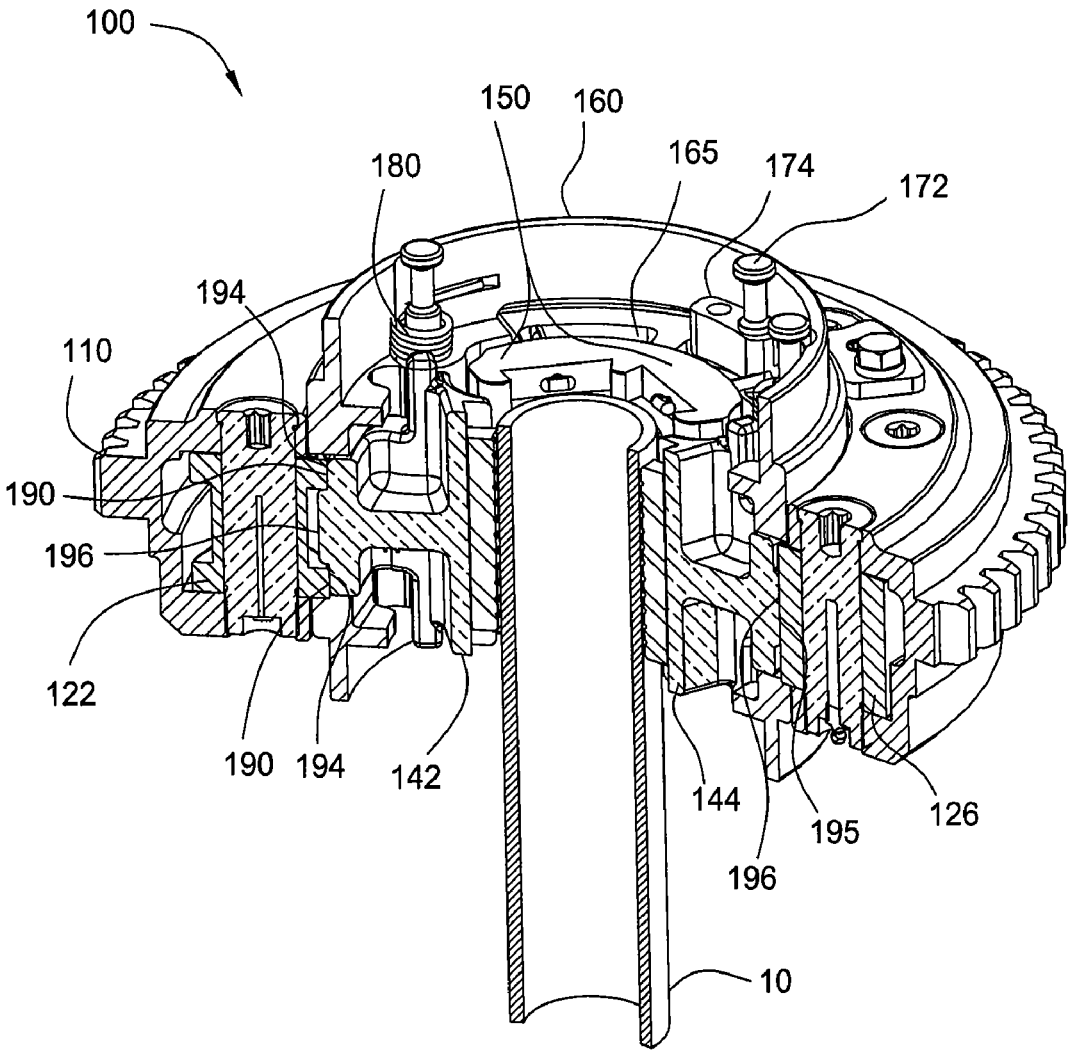
FIGS. 8A and 8B illustrate a cross sectional view of the gripping apparatus in a make up position.
Figure 8B:
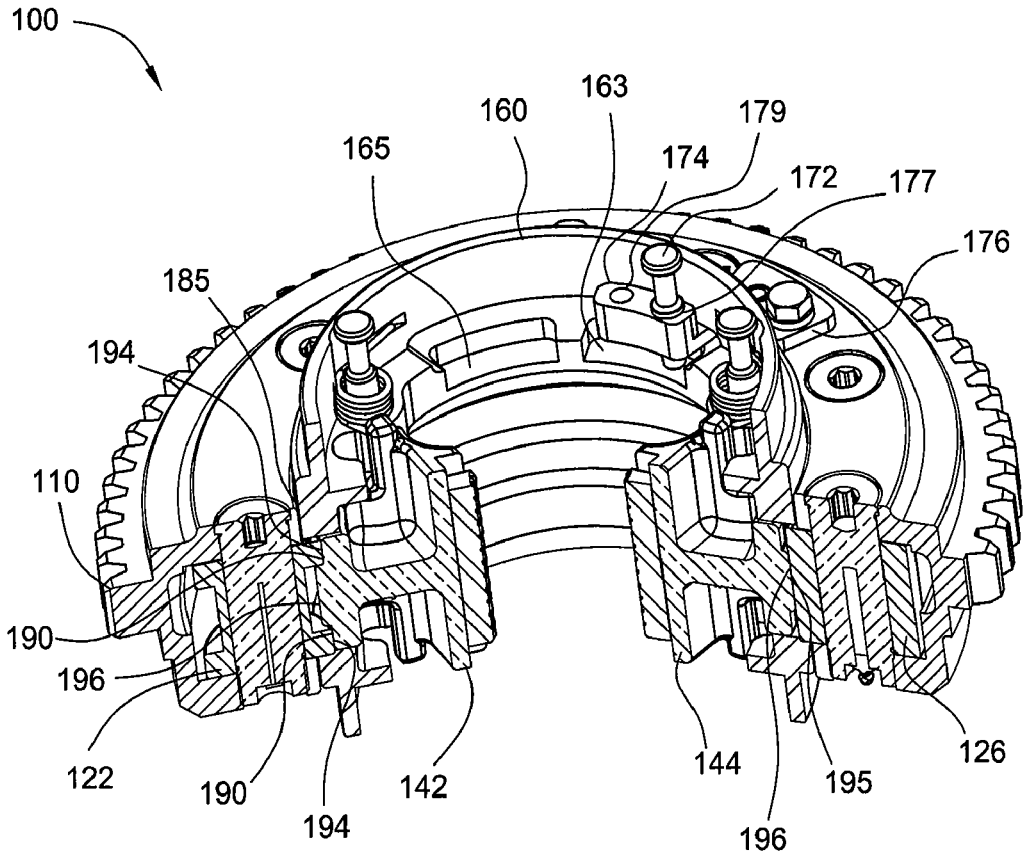

F*igure* 8A also illustrates a cross sectional view of the second active jaw 144 engaged with the non-slotted roller 126 at interface 195. In particular, the non-slotted roller 126 engages the actuating cam surface 196 of the second active jaw 144. The raised actuating cam surface 196 engages the outer diameter of the non-slotted roller 126. In the illustrated position, the non-slotted roller 126 actuates and pivots the second active jaw 144 into contact with the tubular 10 disposed in the gripping apparatus 100, so that a gripping force is applied to the tubular 10. FIG. 8B illustrates the gripping apparatus 100 as shown in FIG. 8A but with the tubular 10 and the passive jaw 150 removed.

Figure 9A:
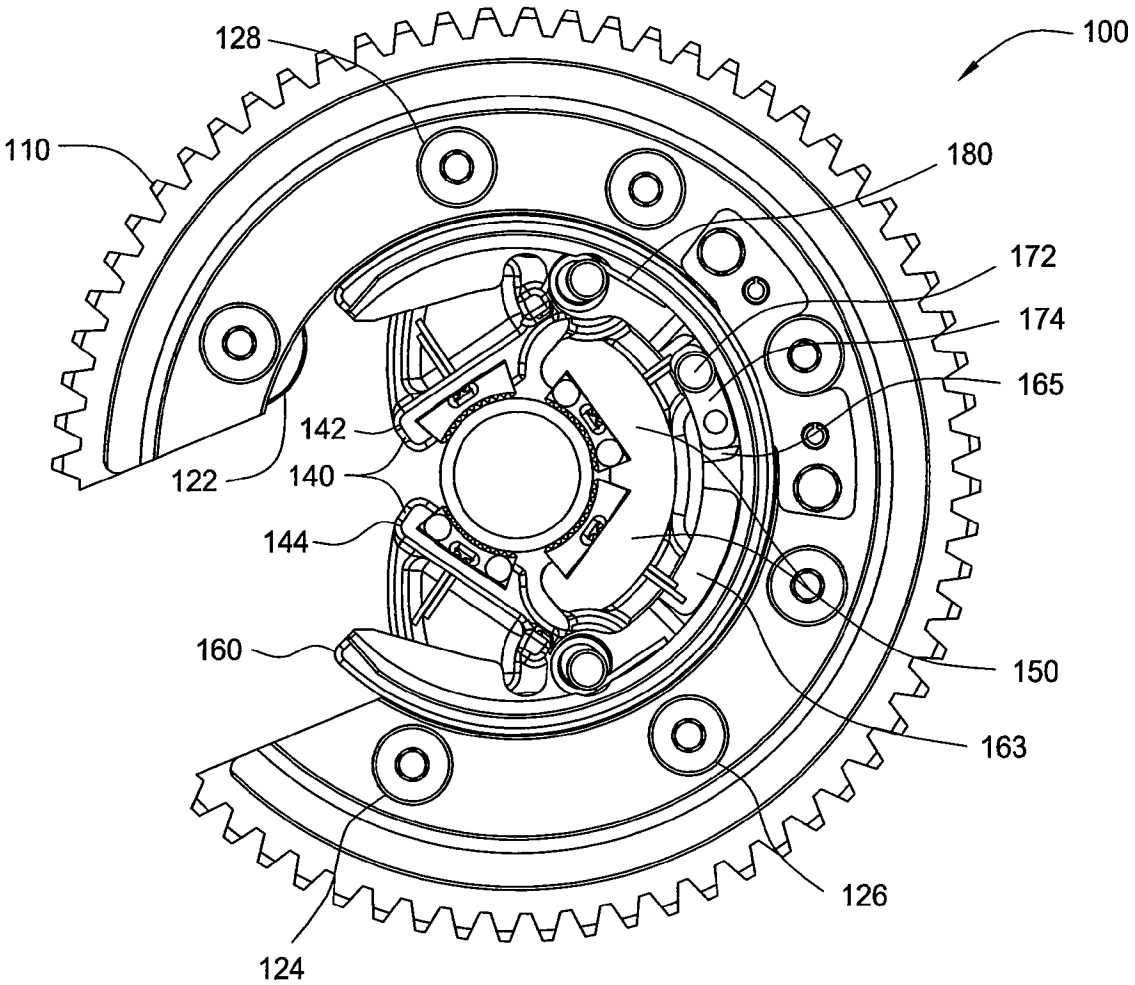
FIGS. 9A and 9B illustrate a top view of the gripping apparatus in a break out mode.
Figure 9B:
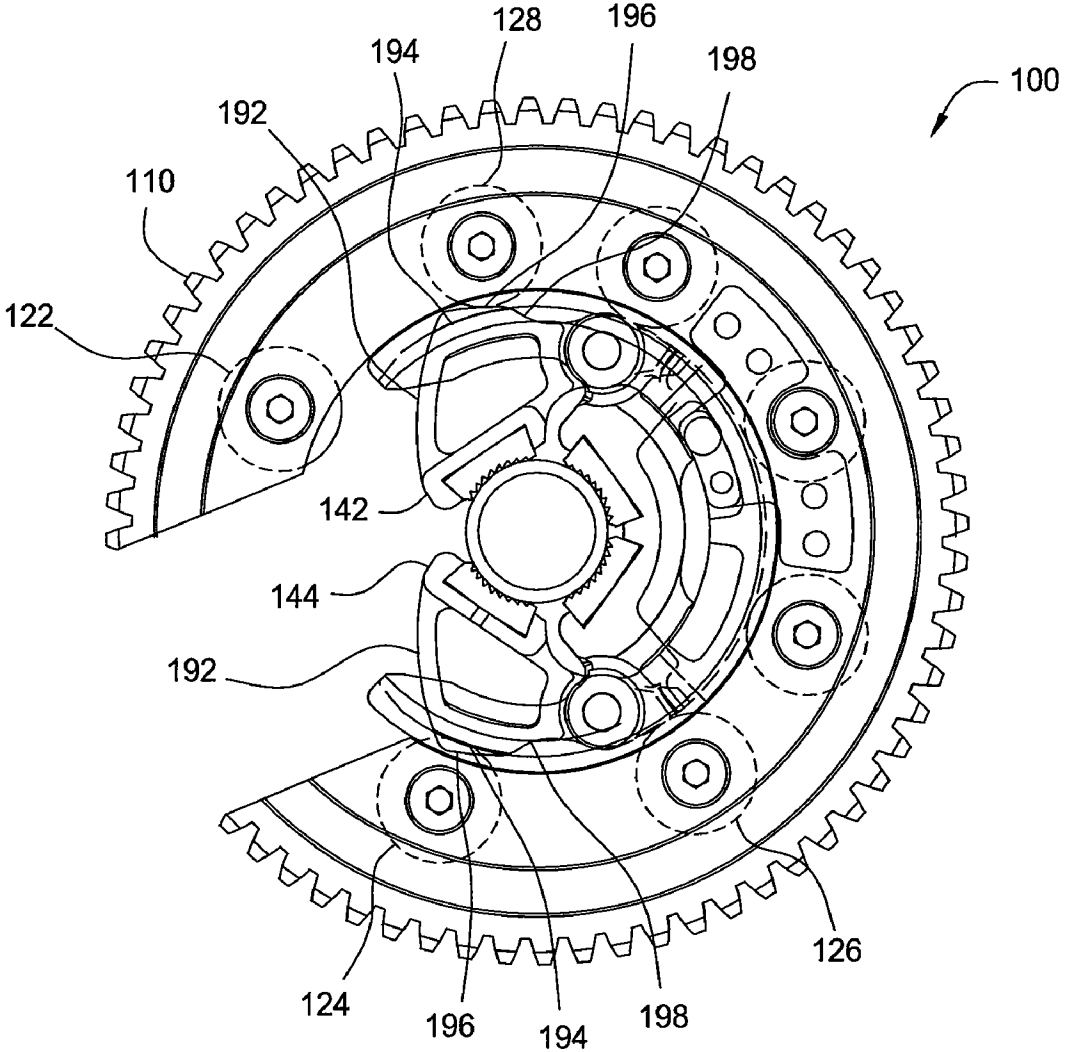

FIGS. 9A and 9B illustrate the gripping apparatus 100 in a break out mode. The active jaws 140 are illustrated in the engaged position. As illustrated, the switch 172 is located in the switch housing 174 so that it extends into the break out slot 165 of the inner ring 160. The outer gear 110 is shown rotated in the counterclockwise direction. The upper and lower sections of the slotted roller 124 of the first group of rollers 120 initially cam along the positioning cam surface 192 of the second active jaw 144 to pivot the second active jaw 144 into position for initial contact with the tubular 10 disposed in the gripping apparatus 100. The upper and lower sections of the slotted roller 124 then cam along the securing cam surfaces 194 of the second active jaw 144 to hold the second active jaw 144 in contact with the tubular 10. The slotted roller 124 does not engage the actuating cam surface 196 of the second active jaw 144, as the actuating cam surface 196 passes between the upper and lower sections of the slotted roller 124. At about the same time, the non-slotted roller 128 of the first group of rollers 120 cams from the retracting cam surface 198 of the first active jaw 142 to the actuating cam surface 196 of the first active jaw 142. The non-slotted roller 128 cams along the actuating cam surface 196 to pivot the first active jaw 142 into engagement with the tubular 10 so that a gripping force is applied to the tubular 10. A reactive force is provided by the passive jaw 150 and the second active jaw 144. Further rotation of the outer gear 110 in the counterclockwise direction will rotate the inner ring 160, and thus the active and passive jaws 140 and 150, thereby rotating the tubular 10 to conduct a break out operation.

After the break out operation is complete, the outer gear 110 is rotated in the clockwise direction to retract the active jaws 140 from engagement with the tubular 10. The slotted roller 124 cams from the securing cam surfaces 194 to the positioning cam surface 192 of the second active jaw 144 to allow the second active jaw 144 to pivot away from the center of the gripping apparatus 100. The non-slotted roller 126 engages the retracting cam surface 198 to fully retract the second active jaw 144. At about the same time, non-slotted roller 128 cams from the actuating cam surface 196 to the retracting cam surface 198 of the first active jaw 142 to pivot the first active jaw 142 away from the center of the gripping apparatus 100 and fully retract the first active jaw 142.

Further rotation of the outer gear 110 in the clockwise direction will rotate the inner ring 160, and thus the active and passive jaws 140 and 150 together. The switch 172 will travel within the break out slot 165 to allow the active jaws 140 to be fully retracted. The switch 172 may then engage the end of the break out slot 165 to prevent further relative rotation between the outer gear 110 and the inner ring 160. The control switch 170 maintains the gripping apparatus 100 in the break out mode.

In an alternative embodiment, the geometries of the slotted rollers 122 and 124 and the geometries of the securing cam surfaces and the actuating cam surface of the active jaws 140 may be reversed. In particular, slotted rollers 122 and 124 may include a middle section that includes an outer diameter greater than the upper and lower sections, and the active jaws 140 may include a single securing cam surface that is disposed and recessed between two raised actuating cam surfaces. In an alternative embodiment, the slotted rollers 122 may form a "T" shaped profile and the active jaws 140 may include corresponding individual securing and actuating cam surfaces disposed adjacent to each other along the backside of the active jaws 140. In an alternative embodiment, the relative rotations of the make up mode and the break out mode may be reversed. In an alternative embodiment, the location of the slotted rollers 122 and 124 and the non-slotted rollers 126 and 128 may be reversed, such that clockwise rotation of the outer gear 110 pivots the first active jaw 142 into engagement with the tubular to provide a gripping force on the tubular, and the second active jaw 144 is held in contact with the tubular.

In one embodiment, during operation, as the components of the gripping apparatus 100 begin to wear, particularly at the camming surfaces and/or the roller surfaces, or as higher torques are applied to the gripping apparatus 100, or as smaller diameter tubulars are introduced into the gripping apparatus 100, each of the active jaws 140 may apply a gripping force on the tubular, such that the gripping apparatus 100 applies a dual-gripping force on the tubular. For example, in the break out mode, the slotted roller 124 may cam along the securing cam surfaces of the second active jaw 144 in a manner to hold the second active jaw 144 in contact with the tubular 10 and/or pivot the second active jaw 144 into engagement with the tubular so that a gripping force is applied to the tubular. At about the same time, the non-slotted roller 128 may also cam along the actuating cam surface of the first active jaw 142 to pivot the first active jaw 142 into engagement with the tubular so that a gripping force is applied to the tubular. The gripping apparatus 100 may therefore apply a dual gripping force on the tubular. The slotted roller 124 may pivot the second active jaw 144 into engagement with the tubular to apply a gripping force as the roller surfaces begin to cam further along the securing cam surfaces, in response to, but not limited to, the situations described above.

In one embodiment, the gripping apparatus 100 may be operable to apply a dual gripping force on the tubular during the make up and break out operations. In one embodiment, each of the active jaws 140 may include a positioning cam surface, an actuating cam surface, and a retracting cam surface, and each of the rollers 120 may be non-slotted rollers. In one embodiment, the camming surfaces of the active jaws 140 and/or the rollers 120 may be modified to pivot each of the active jaws 140 into engagement with the tubular and apply a gripping force on the tubular during the make up and break out operations. In one example, the securing cam surfaces on each of the active jaws 140 may be radiused to allow the slotted rollers 122 and 124 to pivot each of the active jaws 140 into engagement with the tubular to apply a gripping force on the tubular. In another example, the diameters of the upper and lower sections of the slotted rollers 122 and 124 may be increased to engage and pivot each of the active jaws 140 into engagement with the tubular to apply a gripping force on the tubular. Combinations of the above embodiments and examples may be used to allow the gripping apparatus 100 to apply a dual gripping force on the tubular during the make up and break out operations.

Figure 10A:
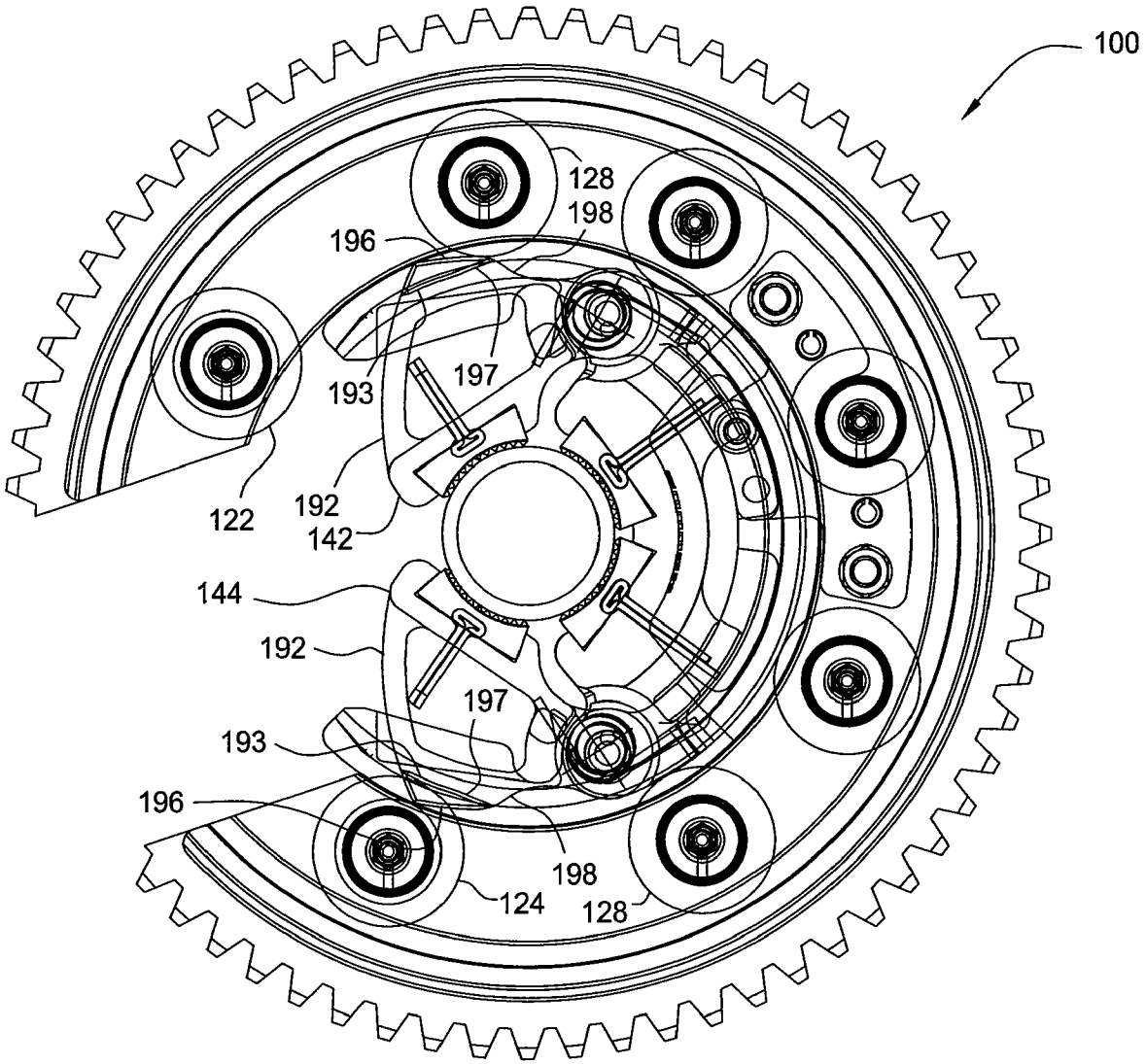
FIGS. 10A and 10B illustrate a top view of the gripping apparatus in a break out position.
Figure 10B:
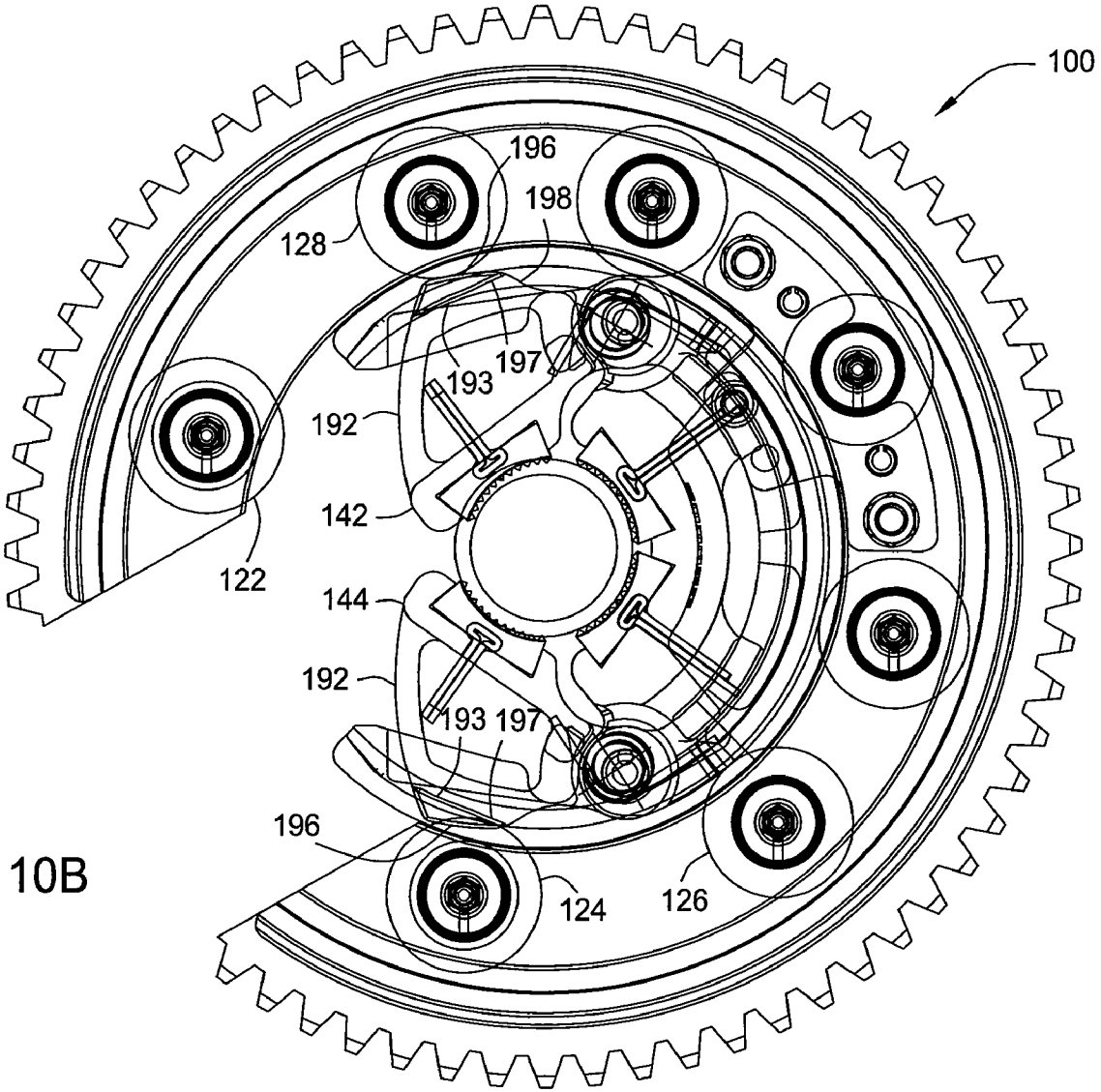

FIGS. 10A and 10B show a modified cam surface on each of the active jaws 140 during a break out operation, according to one embodiment. The modified cam surface includes a securing cam portion 193 and an actuating (also referred to as a "tailout") cam portion 197. The securing cam portion 193 and the actuating cam portion 197 each function similar to the securing and actuating cam surfaces, respectively, as described herein. The actuating cam portion 197 is raised to allow the upper and lower sections of the slotted rollers 122 and 124 to pivot the active jaws 140 into engagement with the tubular in the gripping apparatus 100 to apply a gripping force on the tubular. As shown in FIG. 10A, the slotted roller 124 initially cams along the securing cam portion 193 of the second active jaw 144, thereby securing the second active jaw 144 into contact with the tubular to provide a reactive force against the first active jaw 142. The first active jaw 142 is actuated into engagement with the tubular to apply a gripping force on the tubular by the non-slotted roller 128. As shown in FIG. 10B, the slotted roller 124 may then cam along the actuating cam portion 197 of the second active jaw 144, thereby actuating the second active jaw 144 into engagement with the tubular to apply a gripping force on the tubular. The same functions occur during the make up operation. The gripping apparatus 100 may apply a dual gripping force on the tubular when the rollers engage the actuating cam portion 197 of the modified cam surface on each of the active jaws 140. In one embodiment, about half of the modified cam surface comprises the securing cam portion 193 and about the other half comprises the actuating cam portion 197. In one embodiment, about one third of the modified cam surface comprises the securing cam portion 193 and about the other two thirds comprise the actuating cam portion 197. In one embodiment, about two thirds of the modified cam surface comprises the securing cam portion 193 and about the other one third comprises the actuating cam portion 197. In one embodiment, about 60 percent of the modified cam surface comprises the securing cam potion 193 and about 40 percent of the modified cam surface comprises the actuating cam portion 197.

While the foregoing is directed to embodiments of the invention, other and further embodiments of the invention may be devised without departing from the basic scope thereof, and the scope thereof is determined by the claims that follow.

I claim:

1. A gripping apparatus for making up and breaking out tubular connections, comprising:

an outer gear;

an inner ring rotatably coupled to the outer gear;

a first active jaw pivotably coupled to the inner ring, wherein the first active jaw comprises a first cam surface and a second cam surface; and a first roller and a second roller each coupled to the outer gear, wherein rotation of the outer gear in one direction moves the first roller into engagement with the first cam surface to move the first active jaw into contact with a tubular, and wherein rotation of the outer gear in an opposite direction moves the second roller into engagement with the second cam surface to move the first active jaw into contact with the tubular.

2. The apparatus of claim 1, wherein the first roller comprises an upper end and a lower end, wherein each end includes an outer diameter greater than an outer diameter of a middle section of the first roller.

3. The apparatus of claim 2, wherein the second roller includes a cylindrical, uniform outer diameter.

4. The apparatus of claim 1, wherein the first cam surface includes a first surface and a second surface, wherein the second cam surface is disposed between the first surface and the second surface.

5. The apparatus of claim 1, further comprising:

a second active jaw pivotably coupled to the inner ring, wherein the second active jaw comprises a first cam surface and a second cam surface; and a third roller and a fourth roller each coupled to the outer gear, wherein rotation of the outer gear in the one direction moves the third roller into engagement with the first cam surface to move the second active jaw into contact with a tubular, and wherein rotation of the outer gear in the opposite direction moves the fourth roller into engagement with the second cam surface to move the second active jaw into contact with the tubular.

6. The apparatus of claim 1, further comprising a passive jaw coupled to the inner ring, wherein the passive jaw is operable to provide a reactive force onto the tubular.

7. The apparatus of claim 1, further comprising a control switch coupled to the outer gear, wherein the control switch is operable to engage the inner ring to maintain the apparatus in a make up mode or a break out mode.

8. The apparatus of claim 7, wherein the control switch includes a switch operable to engage a make up slot or a break out slot on the inner ring.

9. The apparatus of claim 1, wherein clockwise rotation of the outer gear actuates the first active jaw into engagement with the tubular to apply a gripping force onto the tubular.

10. The apparatus of claim 1, wherein counterclockwise rotation of the outer gear positions the first active jaw into contact with the tubular.

11. A gripping apparatus for engaging a tubular, comprising:

an outer gear;

a first roller and a second roller each coupled to the outer gear;

an inner ring rotatably coupled to the outer gear; and a first active jaw pivotably coupled to the inner ring and having an actuating, retracting, positioning, and securing cam surface disposed along a backside of the first active jaw, wherein the first roller is configured to contact the actuating and retracting cam surfaces, and wherein the second roller is configured to contact the positioning and securing cam surfaces, upon rotation of the outer gear.

12. The apparatus of claim 11, wherein engagement with the actuating and securing cam surfaces by the first and second rollers, respectively, moves the first active jaw into contact with the tubular.

13. The apparatus of claim 11, wherein the securing cam surface includes a first surface and a second surface, wherein the actuating cam surface is disposed between the first surface and the second surface.

14. The apparatus of claim 11, wherein the second roller includes a dumbbell shaped profile.

15. The apparatus of claim 11, further comprising:

a third roller and a fourth roller each coupled to the outer gear; and a second active jaw pivotably coupled to the inner ring and having an actuating, retracting, positioning, and securing cam surface disposed along a backside of the second active jaw, wherein the third roller is configured to contact the actuating and retracting cam surfaces of the second active jaw, and wherein the fourth roller is configured to contact the positioning and securing cam surfaces of the second active jaw, upon rotation of the outer gear.

16. The apparatus of claim 11, wherein engagement with the retracting cam surface by the first roller moves the first active jaw toward a center of the inner ring, and wherein engagement with the retracting cam surface by the second roller moves the first active jaw away from the center of the inner ring.

17. The apparatus of claim 11, further comprising a passive jaw coupled to the inner ring and operable to provide a reactive force on the tubular.

18. The apparatus of claim 11, further comprising a friction surface disposed between the outer gear and the inner ring and operable to allow relative rotation between the outer gear and the inner ring.

19. The apparatus of claim 15, wherein rotation of the outer gear actuates the first and second active jaws into engagement with the tubular to apply a gripping force onto the tubular.

20. The apparatus of claim 1, wherein the first cam surface and the second cam surface each form about half of a cam surface of the first active jaw.

21. The apparatus of claim 1, wherein the first active jaw includes a retracting cam surface, wherein engagement with the retracting cam surface by one of the first and second rollers retracts the first active jaw from engagement with the tubular.

22. The apparatus of claim 1, wherein the first cam surface and the second cam surface are disposed adjacent to each other along a backside of the first active jaw.

23. A gripping apparatus for engaging a tubular, comprising:

an outer gear;

a camming assembly coupled to the outer gear;

an inner ring rotatably coupled to the outer gear; and a first active jaw and a second active jaw each pivotably coupled to the inner ring and each including a first cam surface and a second cam surface disposed on a backside of the first and second active jaws, wherein the first cam surface is raised relative to the second cam surface, and wherein rotation of the outer gear in either a clockwise or a counterclockwise direction moves a first roller of the camming assembly into engagement with the first cam surface of the first active jaw, and moves a second roller of the camming assembly into engagement with the second cam surface of the second active law.

* * * * *

UNITED STATES PATENT AND TRADEMARK OFFICE

CERTIFICATE OF CORRECTION

PATENT NO. : 7,975,572 B2
APPLICATION NO. : 12/244341
DATED : July 12, 2011
INVENTOR(S) : Nelson It is certified that error appears in the above-identified patent and that said Letters Patent is hereby corrected as shown below:

Column 14, Claim 23, Line 7, please delete "law" and insert --jaw-- therefor.

Signed and Sealed this
Eighteenth Day of October, 2011

David J. Kappos

David J. Kappos
*Director of the United States Patent and Trademark Office*